US007798247B2

(12) United States Patent
Julkunen et al.

(10) Patent No.: US 7,798,247 B2
(45) Date of Patent: Sep. 21, 2010

(54) ARRANGEMENT FOR SUCKING DUST

(75) Inventors: Pasi Julkunen, Pirkkala (FI); Tapani Sormunen, Tampere (FI); Juha Koivula, Tampere (FI); Seppo Renko, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 342 days.

(21) Appl. No.: 11/667,450

(22) PCT Filed: Nov. 9, 2005

(86) PCT No.: PCT/FI2005/050404

§ 371 (c)(1),
(2), (4) Date: Oct. 23, 2007

(87) PCT Pub. No.: WO2006/051168

PCT Pub. Date: May 18, 2006

(65) Prior Publication Data

US 2008/0135301 A1 Jun. 12, 2008

(30) Foreign Application Priority Data

Nov. 11, 2004 (FI) ..... 20045435

(51) Int. Cl.
*E21B 21/07* (2006.01)

(52) U.S. Cl. ..... 175/57; 175/66; 55/283

(58) Field of Classification Search ..... 175/66, 175/213; 55/283, 285.5
See application file for complete search history.

(56) References Cited

U.S. PATENT DOCUMENTS

| | | | | |
|---|---|---|---|---|
| 3,726,562 | A | 4/1973 | Wharton, III | |
| 6,332,308 | B1 | 12/2001 | Miller | |
| 6,578,646 | B2 * | 6/2003 | Juujarvi et al. | 175/66 |
| 2004/0221717 | A1 * | 11/2004 | Armstrong et al. | 95/26 |

FOREIGN PATENT DOCUMENTS

| | | | |
|---|---|---|---|
| DE | 36 05 448 | | 8/1987 |
| JP | 11-173225 | | 6/1999 |
| JP | 2001-173372 | | 6/2001 |
| JP | 2002-004778 | | 1/2002 |
| JP | 2006068690 | A * | 3/2006 |
| SU | 781347 | A1 | 11/1980 |
| SU | 945417 | | 7/1982 |

* cited by examiner

*Primary Examiner*—Daniel P Stephenson
*Assistant Examiner*—Kipp C Wallace
(74) *Attorney, Agent, or Firm*—Drinker Biddle & Reath LLP

(57) ABSTRACT

A method for sucking dust in connection with a rock drilling rig, and a rock drilling rig. The rock drilling rig (1) comprises a dust collection system provided with a suction device (11) to produce suction for sucking dust from a drill hole (8) through a first suction channel (12). The rock drilling rig further comprises a second suction channel (17) allowing the suction effect of the dust collection system to be utilized for sucking dust from a location other than the drill hole, for example from the control cabin (15). Exhaust suction is controlled by means of a control unit (26, 48).

20 Claims, 4 Drawing Sheets

ARRANGEMENT FOR SUCKING DUST

BACKGROUND OF THE INVENTION

The invention relates to a method for sucking dust in connection with a rock drilling rig comprising a movable carrier, control cabin, at least one drilling boom provided with a drilling unit and a dust collection system, in which method dust produced in drilling is sucked from the drilling point with the dust collection system.

The invention further relates to a rock drilling rig comprising: a movable carrier provided with at least one drilling boom at the outer end of which is a rock drilling unit comprising at least a feed beam and a rock drilling machine; a control cabin; and a dust collection system containing at least a suction device, filters and a first suction channel, the dust collection system being arranged to suck dust through a first suction channel from a drill hole drilled with the rock drilling machine.

When holes are drilled into rock, a great deal of dust is produced. A rock drilling rig may be provided with a dust collection system that sucks the dust and takes it away from the drilling site. However, some of the dust may spread around in the drilling site. The control cabin of the rock drilling rig is usually sealed to keep away dust. However, from time to time the operator of the drilling apparatus must leave the cabin and move about in the drilling site, whereby dust and mud consisting of dust and water sticks to his footwear and clothing. When returning to the cabin, the operator then carries the dust in there too, thus causing dry stone dust or dust from the dried mud to spread inside the cabin. The fine particles contained in the stone dust may cause severe damage, such as pneumoconiosis and asthma, in the respiratory organs of the operator. The current means aiming to prevent the dust problem consist of cleaning the footwear before going into the cabin and cleaning the cabin floor from time to time. However, according to observations obtained in this matter, this is not efficient enough to keep dust away from the operator's breathing air.

BRIEF DESCRIPTION OF THE INVENTION

It is an object of the invention to provide a novel and improved method and arrangement for sucking dust in connection with a rock drilling rig to allow problems caused by dust to be prevented.

The method of the invention is characterized by using a conventional dust collection system of the rock drilling rig to remove dust from at least one predetermined second location other than the drilling point; and directing exhaust suction produced to the second location by means of at least one control unit.

The rock drilling rig of the invention is characterized in that the rock drilling rig comprises at least one second suction channel connected to the dust collection system; and that the suction device of the dust collection system is configured to produce a suction effect through the second suction channel at least to one predetermined second location other than the drill hole; and that the rock drilling rig comprises at least one control unit enabling the suction effect produced to the second location to be controlled.

A basic idea of the invention is that a conventional dust collection system of a rock drilling rig is provided with at least one second suction channel, the dust collection system in the rock drilling rig being thus used for removing dust from at least one predetermined second location. This second suction location is other than the drill hole. In addition, the exhaust suction of the second suction channel is controlled by means of one or more control units.

An advantage of the invention is that it allows the conventional dust collection system of the rock drilling rig to be used for removing dust not only at the drill hole but also elsewhere. This makes it possible to remove dust from predetermined locations in connection with the rock drilling rig and thereby allows dust-related problems to be efficiently prevented. Further, since the invention makes use of a dust collection system already available in the rock drilling rig, the system of the invention is relatively simple to construct and does not cause significant additional costs. In other words, the invention makes more versatile use of the existing dust collection system.

An embodiment of the invention is based on the idea that the conventional dust collection system of a rock drilling rig is connected by means of a second suction channel to the control cabin of the apparatus or to the vicinity thereof. This allows the exhaust suction generated by the dust collection system to be used to remove dust carried by the operator.

An embodiment of the invention is based on the idea of producing an exhaust air flow at the lower part of the control cabin by means of the dust collection system and guiding air currents inside the cabin to flow from top to bottom. In this case the second suction channel connects the conventional dust collection system of the rock drilling rig to at least one exhaust air nozzle in the lower part of the control cabin, the exhaust air flow causing the air inside the cabin to flow from top to bottom. An advantage of this is that dust carried into the cabin does not spread around therein but moves from top to bottom with the air currents inside the cabin. Therefore dust does not get into the operator's breathing air but is sucked away from the cabin through the exhaust air nozzle in the leg room. Clean breathing air protects the operator from dust-related illnesses and allergies. In addition, the arrangement of the invention improves the operator's working efficiency and comfort at work. A further advantage is that the arrangement of the invention allows good air quality to be obtained in the cabin essentially irrespective of the actions of the operator.

An embodiment of the invention is based on the idea that the rock drilling rig comprises at least one control unit configured to control the exhaust suction from the cabin on an automated basis. The control unit is provided with at least one control strategy for sucking dust from the cabin. An advantage of automated equipment is that air quality in the cabin does not depend on how careful the operator is, i.e. how well the operator cleans his footwear and clothes before entering the cabin.

An embodiment of the invention is based on the idea of carrying out dust suction always after the operator has entered the cabin and closed the door. This allows the dust that also enters the cabin through the open door and on the operator's footwear to be removed immediately, before it spreads around in the cabin.

An embodiment of the invention is based on the idea that dust suction takes place cyclically after the operator has entered the control cabin and closed the cabin door. This provides a means to remove dust that is produced when the mud consisting of dust and water on the operator's footwear dries, falls off onto the cabin floor and begins to spread. Cyclic suction also enables to remove dust and dirt that gets caught in the tread of the footwear and later falls off.

An embodiment of the invention is based on the idea that the control unit is configured to control both the supply air and the exhaust air of the cabin. In this case the control cabin is provided with an automated air control system that may comprise automated dust removal, air current management and temperature control.

An embodiment of the invention is based on the idea that the bottom part of the control cabin at the operator's leg room is formed into a downward convergent suction space. This suction space is connected to the second suction channel. Dust and other impurities carried on the footwear may drop from the leg room into the suction space and be sucked from there into the dust collection system. The suction space may be shaped so as to have an impact on dust removal and management of air currents.

An embodiment of the invention is based on the idea that the bottom part of the control cabin is provided with a suction space below the operator's leg room. Between the suction space and the leg room there is provided cleaning means, such as a broom, carpet, grate, or the like. The cleaning means remove dust and dirt from the footwear when the operator moves his legs in the leg room and the footwear rubs against the cleaning means. There may be a continuous suction in the suction space to suck the dust and dirt removed by the cleaning means through the cleaning means into the suction space from where the dust is conveyed to the dust collection system.

An embodiment of the invention is based on the idea that the rock drilling rig is associated with a cleaning device that the operator can use to clean his footwear. The cleaning device comprises a cleaning space into which the footwear can be placed for the duration of the cleaning. Further, the second suction channel connects the cleaning space to the dust collection system in the rock drilling rig, which allows the suction effect provided by the existing dust collection system to be utilized for cleaning the footwear. An advantage of the suction device is that it reduces the amount of dust entering the cabin, which may improve breathing air and comfort in the cabin. Moreover, the cleaning devices provide an efficient, rapid and easy means for cleaning footwear, and the cleaning result is not essentially dependent on the motivation or carefulness of the operator.

An embodiment of the invention is based on the idea that the control cabin is associated with at least one hand-held suction unit connected to the dust collection system. The suction unit may be arranged outside the control cabin to allow the operator to clean his clothes and footwear before entering the cabin. The hand-held suction unit may also be inside the control cabin, thus allowing the operator to clean the cabin or his clothing from dust.

An embodiment of the invention is based on the idea that at least one hand-held suction unit is arranged to the vicinity of a critical component or device belonging to the rock drilling rig. This suction unit can then be used to clean the component, such as a radiator, from dust in connection with servicing or before each work shift.

BRIEF DESCRIPTION OF THE FIGURES

The invention will be described in greater detail in connection with the following drawings, in which.

For the sake of clarity some embodiments of the invention disclosed in the Figures is simplified. Like parts are indicated with like reference numerals.

DETAILED DESCRIPTION OF SOME EMBODIMENTS OF THE INVENTION

Figure 1:
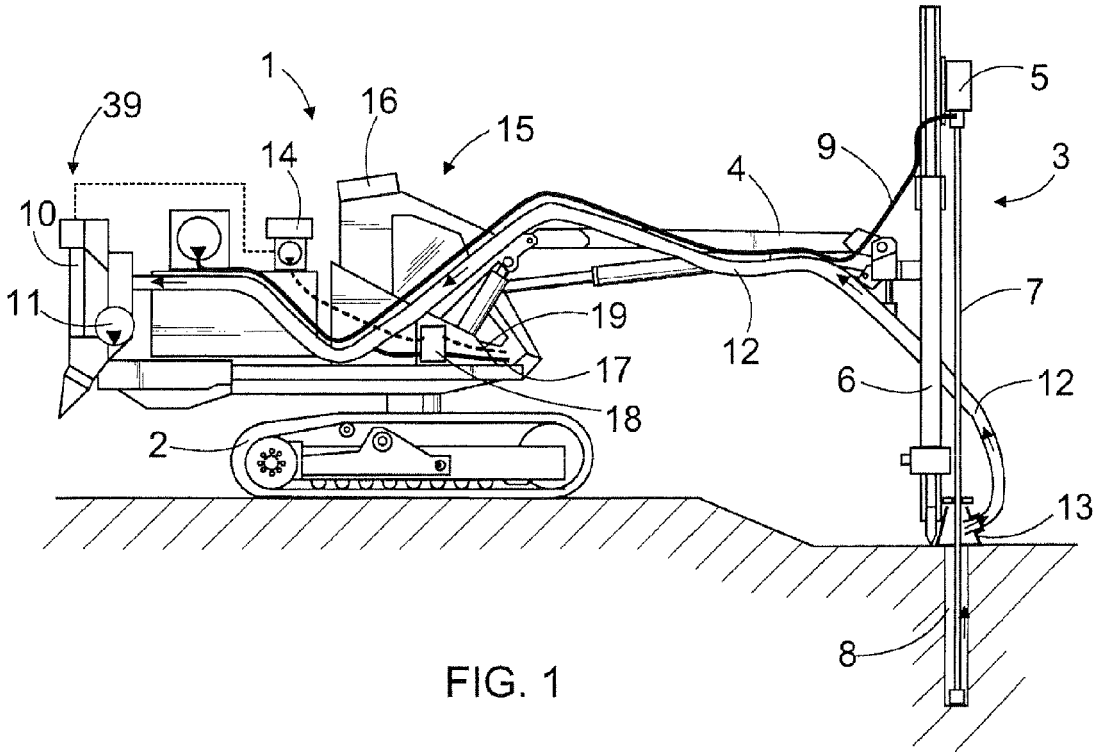
FIG. 1 is a schematic view of a rock drilling rig of the invention provided with a dust collection system.

FIG. 1 shows a rock drilling rig 1 that may comprise a movable carrier 2 provided with a drilling boom 4 equipped with one or more rock drilling units 3. A rock drilling unit 3 may comprise a rock drilling machine 5 that may be moved on a feed beam 6. The rock drilling machine 5 has a percussion device that may be used for delivering impact pulses to a tool 7, the impact pulses causing the tool to break the rock and form a drill hole 8. Cuttings, i.e. dust and other rock material, produced in drilling are flushed during the drilling from the drill hole 8. A flushing medium, such as compressed air, may be supplied through a flushing medium channel 9 and further through the tool 7 into the drill hole 8 to push the cuttings toward the mouth of the drill hole 8. The rock drilling rig 1 may comprise a dust collection system sucking the cuttings from the mouth of the drill hole 8 and taking it forward to filters 10 that separate solid material from air. The dust collection system may contain a suction device 11 that may be arranged at the back of the rock drilling rig 1. The suction device 11 is configured to generate the required negative pressure. The suction device 11 is connected to one or more suction channels 12 at the outermost ends of which may be a suction funnel 13 to be arranged to the mouth of the drill hole 8. The dust collection system may comprise one or more coarse filters for filtering coarse rock material and also one or more fine filters for filtering dust and corresponding fine rock material. Further, the dust collection system may be provided with a spraying device 14 for producing a fine mist of water. The water mist spray can be used for binding dust, for example.

The mine vehicle 1 may further comprise a control cabin 15 for the operator and the control devices. The cabin 15 may be sealed to prevent dust from entering there. The cabin 15 may also be equipped with a supply air device 16, such as a ventilator, an air conditioner, or the like. The supply air device 16 enables filtered air to be supplied into the control cabin 15. It is also possible to arrange a slight positive pressure inside the control cabin 15 to prevent dust from entering the cabin between sealing gaps and the like.

FIG. 1 further shows that the suction channel 12 of the dust collection system is connected to the control cabin 15 via a second suction channel 17. Flow of air in the second suction channel 17 can be controlled by means of a control device 18. Further, the spraying device 14 may be connected to the control cabin 15 via a spray channel 19. The control device 18 may also control the flow in the spray channel 19.

Figure 2:
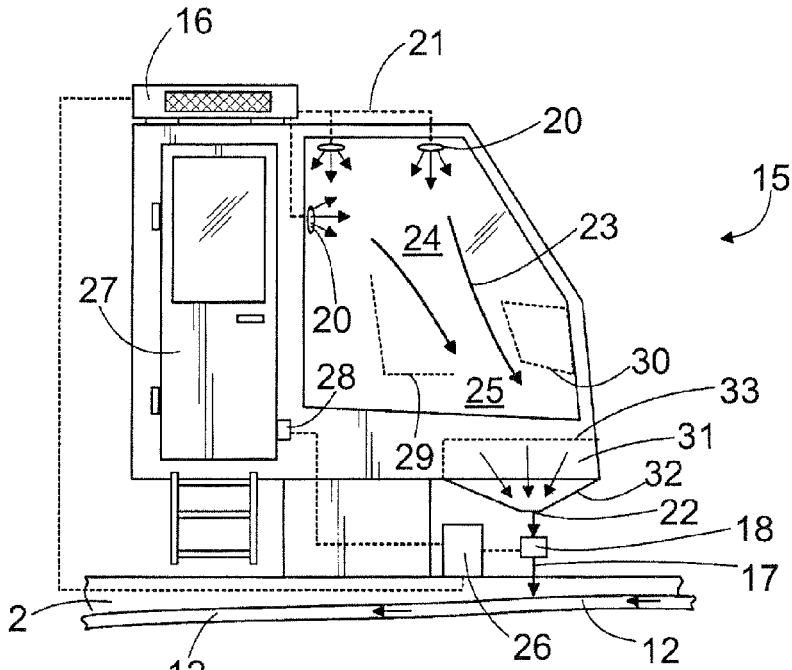
FIG. 2 is a schematic view of a control cabin of a rock drill apparatus of the invention and air currents inside the cabin.

The control cabin 15 of FIG. 2 may comprise one or more supply air nozzles 20 through which supply air may be supplied into the control cabin 15. The supply air nozzles 20 may be arranged to the upper part of the control cabin 15 and they may be connected to the supply air device 16 via channels 21. Further, the lower part of the control cabin 15 may be provided with one or more exhaust air nozzles 22 connected by the second suction channel 17 to the suction channel 12 belonging to the dust collection system of the rock drilling rig 1. Air currents 23 inside the control cabin 15 may be arranged such that their direction is always from top to bottom, i.e. from the operator's breathing air level 24 towards the leg room 25. This prevents dust carried into the cabin 15 on the operator's footwear and clothes from spreading inside the cabin 15 and getting into the operator's breathing air. The volume, direction etc. of the air currents 23 can be controlled by influencing the flows of air supplied through the supply air nozzles 20. The air currents 23 can also be influenced by controlling with the exhaust air nozzle 22 the volume of air to be sucked from the control cabin 15. The volume of the air current 23 from top to bottom can be dimensioned so that the operator will not experience any unpleasant feeling of draught due to too strong currents of air and, on the other hand, so that the direction of the air current 23 is not reversed in any circumstances, i.e. air does not flow from bottom to top, and cause dust to rise into the operator's breathing air. The supply air nozzles 20 are therefore always placed above the leg room 25. Further, it is possible to maintain a slight positive pressure inside the control cabin 15 by setting the flow of the supply air stronger than the exhaust air flow. This way dust does not tend to penetrate into the cabin 15 through sealing gaps and the like. However, the control strategy may require momentary strong exhaust air flows during which the control cabin 15 may be subjected to a negative pressure for a few moments.

The rock drilling rig 1 may be provided with one or more control units 26 that may be configured to control the supply of air into the cabin 15 and the removal of air from the cabin 15. The control unit 26 may be configured to control the supply air device 16 and the supply air nozzles 20. Further, the control unit 26 may control the control device 18 arranged to the second suction channel 17 and adjust the air current leaving the control cabin 15 into the suction channel 12. The control device 18 may comprise a valve or another similar member, for example, suitable for flow control. The control unit 26 may be provided with one or more control strategies according to which the air currents 23 in the control cabin 15 are to be controlled. According to one control strategy a strong suction is applied after the operator has entered the control cabin and closed the door 27 of the cabin 15. This enables to immediately remove dust carried into the cabin in the operator's footwear and dust that enters as the door is opened from the cabin 15, before the dust spreads to the level of the operator's breathing air 24. The door 27 may be connected to a sensor 28 conveying detection data to the control unit 26. It is also possible to apply a control strategy according to which a strong cyclic suction is carried out at predetermined intervals after the operator has entered the cabin 15 and closed the cabin door 27. This allows also dust resulting from dried mud built up from liquid and dust and carried into the cabin 15 in the footwear to be removed from the cabin 15. A continuous weak suction may be applied through the exhaust air nozzle 22 to ensure that the direction of the air currents 23 is towards the leg room 25. The suction can be increased according to the control strategy.

In addition to the sensor monitoring the door 27, the control cabin 15 may be provided with other detecting elements providing detection data on the basis of which exhaust air suction can be controlled. For example, the control cabin 15 may be provided with a motion sensor enabling the presence of the operator inside the cabin 15 to be detected. The control cabin 15 may also be provided with a switch which the operator may use to manually switch on an exhaust suction of a greater intensity when he notices dust in the cabin. For the sake of clarity, FIG. 2 shows a seat 29 and a control desk 30 drawn with dashed lines.

The control cabin 15 may be provided with a suction space 31 below the leg room 25, the second suction channel 17 being connected to the suction space via the exhaust air nozzle 22. The bottom of the suction space 31 may be downward convergent to enhance the moving of dust and dirt towards the exhaust air nozzle 22 that may be placed to the lower part of the suction space 31. It is also possible that the bottom of the suction space 31 is formed by the bottom 32 of the control cabin 15 that may be designed in a desired manner to guide dust, dirt and air currents. Thus the bottom of the control cabin 15 may be provided with a downward convergent portion, for example. The suction space 31 may comprise a cover part 33, in which case a continuous negative pressure may be arranged in the suction space 31. However, the cover part 33 enables dust to be sucked from the leg room 25.

Figure 3:
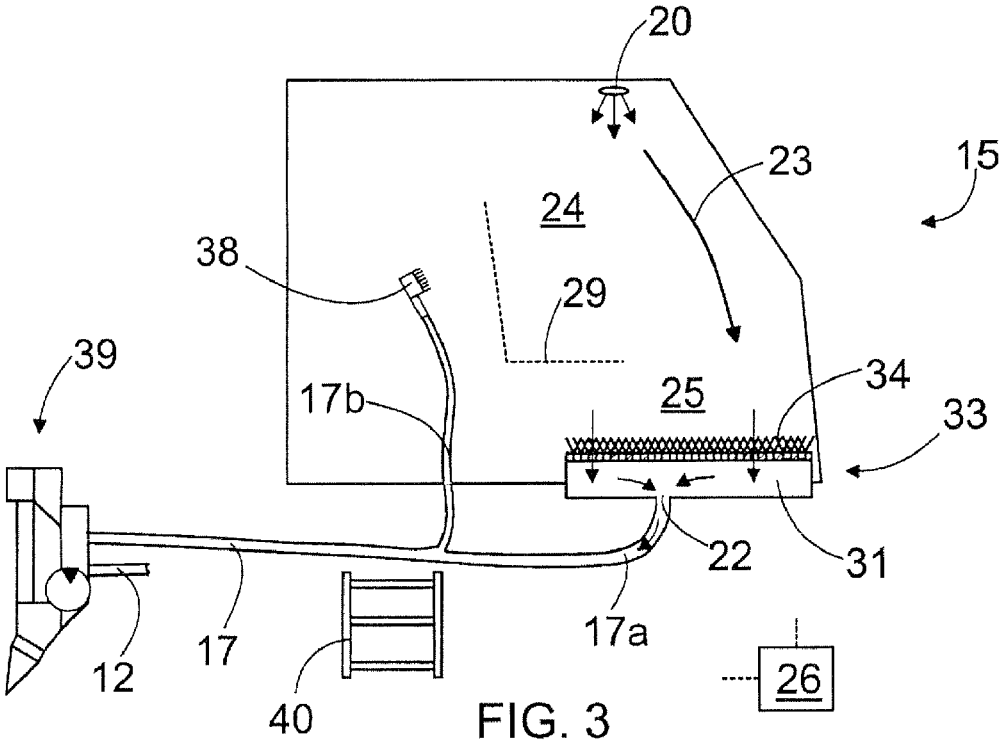
FIG. 3 is a schematic view of a second control cabin of a rock drilling ring.

In the control cabin 15 of FIG. 3 there is provided a box-like suction space 31 below the leg room 25. The cover part 33 of the suction space 31, i.e. the side facing the leg room 25 may be provided with cleaning members 34, such as brushes. When the operator moves his feet, the brushes may remove dust and dirt from the operator's footwear. The cover part 33 may also be provided with openings through which the dust and dirt detached by the brushes can be sucked into the suction space 31. Alternatively, the cover part 33 may consist of an air permeable carpet or grate, which is also suitable for mechanically removing dust from footwear and through which the detached dust can be sucked into the suction space 31. The suction space 31 may be subjected to a continuous, relatively weak suction acting on the control cabin 15 through the openings in the cover part 33 and tending to direct the air currents 23 from top to bottom. Suction in the suction space 31 may be increased according to the control strategy to remove dust and dirt that is in the suction space 31 and caught in the cleaning members 34. The suction space 31 may be connected to the suction channel 12 leading to the rock drilling unit 3 by means of the second suction channel 17, or the suction space 31 may be directly connected via the second channel 17 to a dust suction unit 39, as illustrated in FIG. 3.

Further, the rock drilling rig 1 may comprise one or more hand-held suction units 38 that may be connected to the suction unit 39 or the suction channel 12 via a suction channel 17*b*. The suction unit 38 may be arranged in connection with the control cabin 15 to allow the operator to use it to clean his clothes and footwear. The suction unit 38 may be provided with a suction nozzle or a brush for cleaning. The suction channel 17*b* may be a flexible hose. The suction unit 38 may be arranged outside the control cabin 15, in connection with the entrance 40, for example. The operator can thus use the suction unit 38 for cleaning himself before entering the cabin 15. This enables to reduce the amount of dust carried into the control cabin 15. Further, a suction unit 38 may also be provided inside the cabin 15 for the operator to clean his clothes and footwear. In addition, the suction unit 38 can be used for cleaning the cabin 15. Yet another possibility is to arrange the suction unit 38 to the vicinity of a critical device, such as a radiator, electric switch box, air filters, or the like. The critical component can then be cleaned during servicing and downtime.

Figure 4:
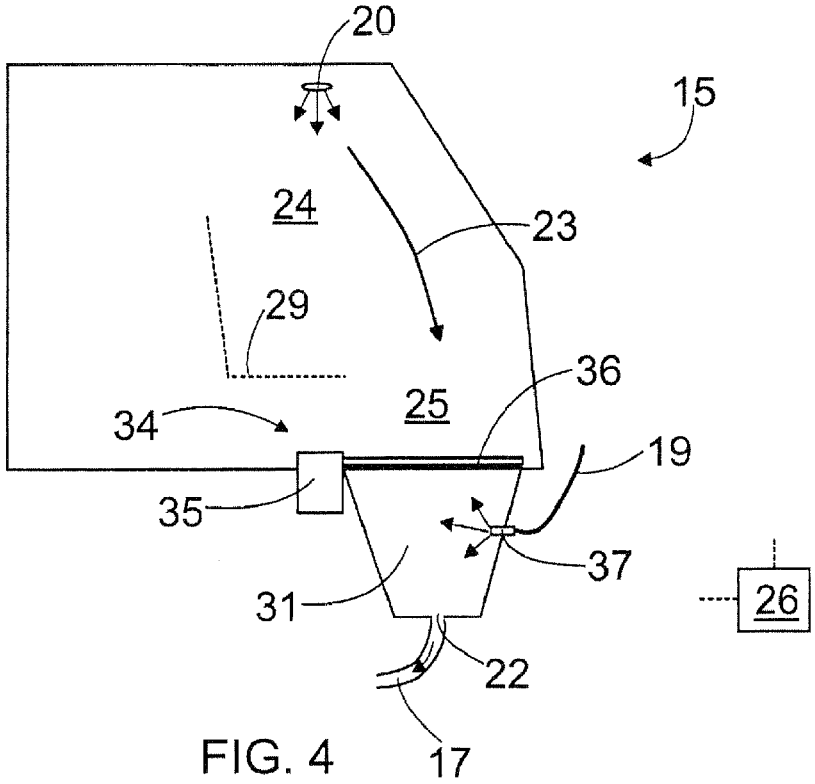
FIG. 4 is a schematic view of a third control cabin of a rock drilling rig.

In the control cabin 15 of FIG. 4 there is provided a funnel-shaped suction space 31 below the leg room 25. The upper part of the suction space 31 may be provided with closing means 34 that may contain an actuator 35 for opening and closing the closing members 36. The closing members 36 may be closing plates provided with openings, for example, and moved in relation to each other such that when the closing mechanism is to be opened, the openings are aligned and when the closing mechanism is to be closed, the openings are out of alignment. Alternatively, the closing mechanism may comprise a plural number of closing plates that may be turned in relation to their longitudinal axis to open and close the closing mechanism. The closing member 36 may also be some other mechanism suitable for the purpose. There may be a continuous, fairly low negative pressure in the suction space 31 when the closing members 36 are closed. The suction effect may be guided by means of suitable openings or channels to the leg room 25 such that the air currents 23 inside the control cabin 15 are always toward the leg room 25. When the closing members 36 are opened, a strong suction may be produced into the suction space 31 to suck the dust collected into the suction space 31 and the dust still in the leg room 25 into the dust collection system.

In connection with the suction space 31 there may be provided a nozzle 37 through which liquid mist may be supplied to flush the suction space 31. Liquid mist can also be used for binding dust in the suction space 31. The nozzle 37 is connected through a spray channel 19 to a spraying device 14 provided in the rock drilling rig 1. It is also possible that the suction unit 38 of FIG. 3 is connected to the spraying channel 19, in which case the suction unit 38 can be used for flushing off dust.

Figure 5:
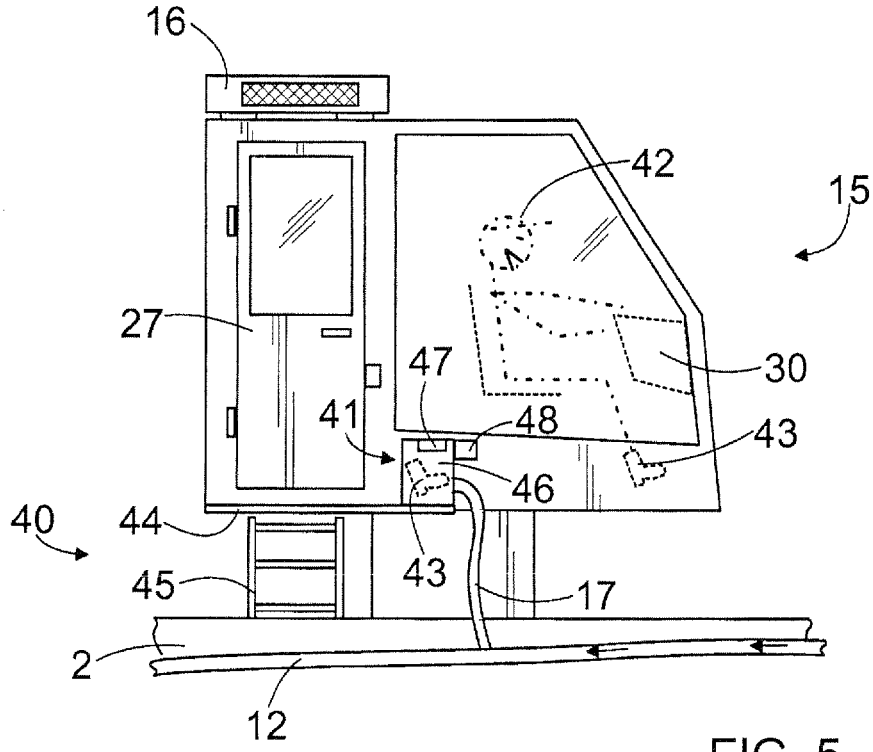
FIG. 5 is a schematic view of a fourth control cabin of a rock drilling rig and a cleaning device provided in connection with the cabin.

FIG. 5 shows a control cabin 15 with one or more cleaning devices 41 arranged to the vicinity of its entrance 40 for the operator 42 to clean his footwear 43 before entering the cabin 15. The cleaning device 41 may be arranged outside the control cabin 15, in front of or next to the door 27 of the cabin 15. In front of the door 27 there may be a landing 44 to which the stairs between the carrier 2 and the control cabin 15 may lead. The cleaning device 41 may be arranged onto the landing 44 or, alternatively, it may be arranged to the outer wall of the control cabin 15 or to a recess in the outer wall. The cleaning device 41 may be a separate device or integrated into the control cabin 15. The cleaning device 41 may comprise a cleaning space 46 capable of accommodating the items of footwear 43 one at a time or both at the same time. The second suction channel 17 may connect the cleaning space 46 to the suction channel 12 belonging to the dust collection system of the rock drilling rig 1. In that case it is possible to create a strong suction into the cleaning space 46 to remove dust and dirt from the boots 43 into the suction unit 39. The cleaning device 41 may be equipped with one or more detecting devices 47 detecting the boot 43 in the cleaning space 46 and starting the cleaning procedure. The cleaning device 41 may comprise a control unit 48 and thus operate fully automatically on the basis of the control strategy provided in the control unit 48 and the data received from the detecting device 47. On the other hand, the cleaning device 41 may comprise operating switches for manual operation thereof. The cleaning space 46 may be provided with a plural number of suction nozzles to enable suction produced by the dust collection system to be directed efficiently to the footwear 43 for dust removal.

Figure 6:
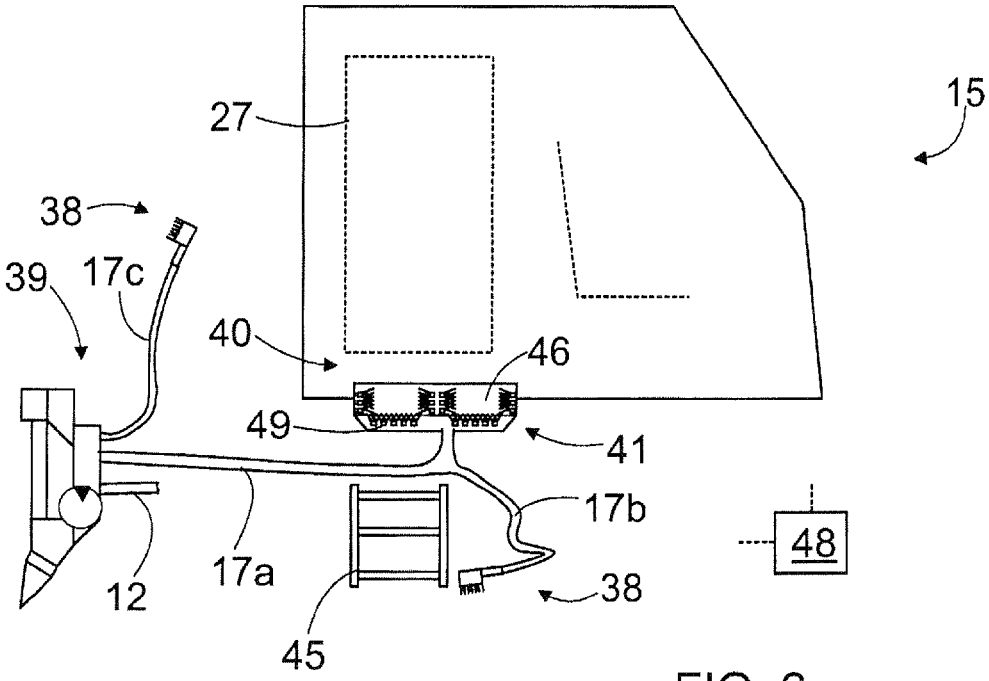
FIG. 6 is a schematic view of a fifth control cabin of a rock drilling rig and a cleaning device provided in connection with the cabin.

In the application of FIG. 6 the cleaning device 41 is arranged inside the control cabin 15, in front of the door 27. In other words, also in this case the cleaning device 41 is arranged to the vicinity of the entrance 40 of the control cabin 15. This means that the operator 42 unavoidably passes through the cleaning device 41 when entering the cabin 15. The cleaning space 46 in the cleaning device 41 may be open from the top to allow the operator 42 to step into the cleaning space 46 on his footwear 43. The cleaning space 46 may be provided with brushes or similar cleaning members 49 arranged at the bottom or on the sides thereof for the purpose of mechanically removing dust and dirt carried by the footwear 43. The cleaning members 49 may be immovably arranged so that the operator 42 is able to move his feet against the cleaning members 49 to remove the dust. This mechanical effect together with a strong suction efficiently removes dust from the footwear 43. Moreover, when the door 27 is closed, suction taking place through the cleaning device 41 may at the same time remove any dust possibly carried into the control cabin 15 through the open door 27. The door 27 may be connected to a detecting device 28 that detects the closing of the door 27. The cleaning device 41 may be connected through the second suction channel 17*a* directly to the suction unit 39 or, alternatively, through the second suction channel 17 and the first suction channel 12 to the dust collection system.

Further, the rock drilling rig 1 may comprise one or more hand-held suction units 38 that may be connected through the suction channel 17*b* to the second suction channel 17*a* leading to the cleaning device 41 or, alternatively, the suction unit 38 may be connected by a separate suction channel 17*c* directly to the suction unit 39. The exhaust suction of a separate suction unit 38 may be controlled manually or, in some cases, by means of the control unit 26 or 48.

Figure 7:
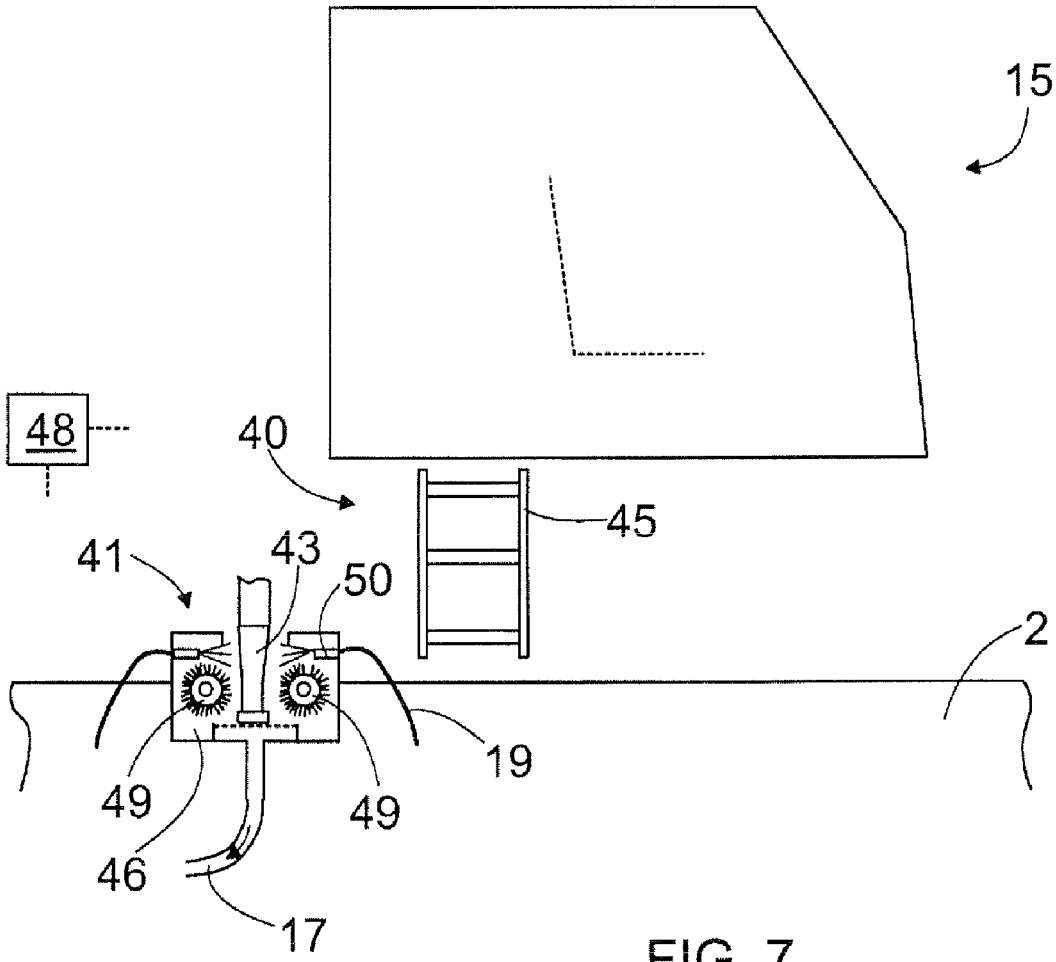
FIG. 7 is a schematic view of yet another control cabin of a rock drilling rig and a cleaning device provided at the vicinity of the entrance thereof.

In the application of FIG. 7 the cleaning device 41 is on the carrier 2 of the rock drilling rig 1. However, the cleaning device 41 is placed at the vicinity of the entrance 40 of the control cabin 15 to be easy to use for the operator 42. The cleaning device 41 may comprise one or more moving cleaning members 49, such as rotating brushes for mechanically removing dust. The cleaning members 49 may be operated for example by means of an actuator that receives its driving power from the suction generated by the dust collection system. It is also possible to spray liquid mist into the cleaning space 46 from the spraying device 14. The spray channel 19 may be connected to a spraying nozzle 50. A plural number of spraying nozzles 50 may be provided and they may be located in a suitable manner for wet flushing dust from the footwear 43. One option is to direct liquid mist through the rotating brushes into the cleaning space. After the wet flushing the footwear 43 may be dried by means of suction.

The rock drilling rig 1 may be provided with means forcing the operator 42 to use the cleaning device 41 before he is able to start working in the control cabin 15. According to one arrangement the cleaning device 41 is arranged at the entrance 40 such that the operator 42 is unable to enter the cabin 15 without cleaning his footwear 43 in the cleaning device 41. The cleaning device 41 may thus be placed in front of the door 27 of the control cabin 15 or in the stairs 45. It is also possible to arrange detection data to be relayed from the detecting device 47 arranged in connection with the cleaning device 41 to the control unit of the rock drilling rig 1 that may raise an alarm if the operator 42 does not clean his footwear 43 in the cleaning device 41. Another possibility is to prevent the opening of the door 27, for example, or some other action, if the cleaning of the footwear 43 is neglected.

The control unit 26, 48 shown in FIGS. 2 to 7 may be a computer or a programmable logic, for example, arranged to control the exhaust flow from the control cabin 15 and the cleaning device 41. The control unit 26, 48 may receive measurement or detection data relayed from one or more sensors, such as a pressure sensor, temperature sensor, motion sensor, or some other sensor indicating the need for exhaust suction. The control unit 26, 48 may thus be provided with information for control purposes from the control cabin or the cleaning device, for example. The control unit 26, 48 may be configured to control one or more valves to control the flow and pressure of exhaust suction. Further, the control unit 26, 48 may be arranged to control other valves, for example a valve arranged into the spraying channel, a valve arranged into the supply air channel of the control cabin, etc. Further still, the control unit 26, 48 may be configured to control other actuators and control devices possibly associated with exhaust suction control measures. The control unit 26, 48 may be provided with one or more control strategies installed in advance or as need arises to allow the control unit 26, 48 to control the exhaust suction. The control strategy may be for example a cyclically functioning control instructing the operator, or the control may be based on a semi-automatic or fully automatic principle. Further, in some cases a command issued manually or by remote control may be supplied to the control unit to make the unit control exhaust suction.

It should be noted that the different embodiments and features of the invention presented in this application may be combined to produce different variations. In some cases it is also possible to apply the disclosed solutions as such, irrespective of other disclosed features.

The drawings and the related specification are only intended to illustrate the inventive idea. The details of the invention may vary within the scope of the claims.

The invention claimed is:

1. A rock drilling rig, comprising:

a movable carrier provided with at least one drilling boom at the outer end of which is a rock drilling unit comprising at least a feed beam and a rock drilling machine, a control cabin, a dust collection system containing at least a suction device, filters and a first suction channel, the dust collection system being arranged to suck dust through a first suction channel from a drill hole drilled with the rock drilling machine, at least one second suction channel connected to the dust collection system, wherein the suction device of the dust collection system is configured to produce a suction effect through the second suction channel at least to one predetermined second location other than the drill hole, and the rock drilling rig comprises at least one control unit enabling the suction effect produced at the second location to be controlled, and the dust collection system is connected to the control cabin through the second suction channel, and wherein, the lower part of the control cabin is provided with at least one exhaust air nozzle to which the second suction channel is connected, and the exhaust air flow taking place through the exhaust air nozzle is arranged such that the direction of the air current inside the control cabin is substantially always from top to bottom.

2. A rock drilling rig according to claim 1, wherein at least one control unit is arranged to control the exhaust air flow taking place through the exhaust air nozzle, and the control unit is provided with at least one control strategy for automatically controlling the exhaust air flow.

3. A rock drilling rig according to claim 1, wherein the rock drilling rig comprises a supply air device for supplying filtered supply air through supply air nozzles into the control cabin, and the supply air nozzles are placed above the leg room, which is at the lower part of the control cabin.

4. A rock drilling rig according to claim 1, wherein the rock drilling rig comprises at least one cleaning device for cleaning the footwear of the operator, the cleaning device comprises a cleaning space connected by the second suction channel to the conventional dust collection system of the rock drilling rig, the cleaning device being arranged to utilize the suction formed with the suction device to clean the footwear, and the cleaning device is provided with at least one control unit for controlling the exhaust suction.

5. A rock drilling rig according to claim 1, wherein the rock drilling rig comprises at least one cleaning device for cleaning the footwear of the operator, the cleaning device comprises a cleaning space connected by the second suction channel to the conventional dust collection system of the rock drilling rig, the cleaning device being arranged to utilize the suction formed with the suction device to clean the footwear, the cleaning device is provided with at least one control unit for controlling the exhaust suction, and the cleaning device is arranged to the vicinity of the entrance of the control cabin.

6. A rock drilling rig according to claim 1, wherein the rock drilling rig comprises at least one cleaning device for cleaning the footwear of the operator, the cleaning device comprises a cleaning space connected by the second suction channel to the conventional dust collection system of the rock drilling rig, the cleaning device being arranged to utilize the suction formed with the suction device to clean the footwear, the cleaning device is provided with at least one control unit for controlling the exhaust suction, and the cleaning device comprises at least one cleaning member for mechanically removing dust from the footwear.

7. A method for sucking dust in connection with a rock drilling rig, the rock drilling rig comprising a movable carrier, a control cabin, at least one drill boom provided with a drilling unit, and a dust collection system, the method comprising:

sucking dust produced in drilling with the dust collection system from the drilling point, using the conventional dust collection system of the rock drilling rig to remove dust from at least one predetermined second location other than the drilling point, controlling exhaust suction produced to the second location by means of at least one control unit, and producing an exhaust air flow into the control cabin by means of the conventional dust collection system of the rock drilling rig.

8. A method according to claim 7, comprising producing an exhaust air flow into the lower part of the control cabin by means of the conventional dust collection system of the rock drilling rig, and guiding air currents inside the control cabin to flow from top to bottom.

9. A method according to claim 7, comprising producing an exhaust air flow into the lower part of the control cabin by means of the conventional dust collection system of the rock drilling rig, guiding air currents inside the control cabin to flow from top to bottom, and controlling exhaust suction in the control cabin automatically with at least one control unit and according to at least one control strategy provided therein.

10. A method according to claim 7, comprising producing an exhaust air flow into the lower part of the control cabin by means of the conventional dust collection system of the rock drilling rig, guiding air currents inside the control cabin to flow from top to bottom, controlling exhaust suction in the control cabin automatically with at least one control unit and according to at least one control strategy provided therein, and, performing momentarily a strong exhaust suction always when the operator has entered the control cabin and closed the door.

11. A method according to claim 7, comprising producing an exhaust air flow into the lower part of the control cabin by means of the conventional dust collection system of the rock drilling rig, guiding air currents inside the control cabin to flow from top to bottom, controlling exhaust suction in the control cabin automatically with at least one control unit and according to at least one control strategy provided therein, and performing a plural number of strong, cyclic exhaust suctions at predetermined intervals after the operator has entered the control cabin and closed the door.

12. A rock drilling rig, comprising:

a movable carrier provided with at least one drilling boom at the outer end of which is a rock drilling unit comprising at least a feed beam and a rock drilling machine, a control cabin, a dust collection system containing at least a suction device, filters and a first suction channel, the dust collection system being arranged to suck dust through a first suction channel from a drill hole drilled with the rock drilling machine, at least one second suction channel connected to the dust collection system, and wherein the suction device of the dust collection system is configured to produce a suction effect through the second suction channel at least to one predetermined second location other than the drill hole, and the rock drilling rig comprises at least one control unit enabling the suction effect produced at the second location to be controlled, and the dust collection system is connected to the control cabin through the second suction channel, and wherein the lower part of the control cabin is provided with at least one suction space located at the operator's leg room, and the suction space is downward convergent and connected to the second suction channel by the exhaust air nozzle.

13. A rock drilling rig according to claim 12, wherein the dust collection system is connected to the control cabin through the second suction channel, the lower part of the control cabin is provided with at least one exhaust air nozzle to which the second suction channel is connected, the exhaust air flow taking place through the exhaust air nozzle is arranged such that the direction of the air current inside the control cabin is substantially always from top to bottom, at least one control unit is arranged to control the exhaust air flow taking place through the exhaust air nozzle, and the control unit is provided with at least one control strategy for automatically controlling the exhaust air flow.

14. A rock drilling rig according to claim 12, wherein the dust collection system is connected to the control cabin through the second suction channel, the lower part of the control cabin is provided with at least one exhaust air nozzle to which the second suction channel is connected, the exhaust air flow taking place through the exhaust air nozzle is arranged such that the direction of the air current inside the control cabin is substantially always from top to bottom, the rock drilling rig comprises a supply air device for supplying filtered supply air through supply air nozzles into the control cabin, and the supply air nozzles are placed above the leg room, which is at the lower part of the control cabin.

15. A rock drilling rig according to claim 12, wherein the rock drilling rig comprises at least one cleaning device for cleaning the footwear of the operator, the cleaning device comprises a cleaning space connected by the second suction channel to the conventional dust collection system of the rock drilling rig, the cleaning device being arranged to utilize the suction formed with the suction device to clean the footwear, and the cleaning device is provided with at least one control unit for controlling the exhaust suction.

16. A rock drilling rig according to claim 12, wherein the rock drilling rig comprises at least one cleaning device for cleaning the footwear of the operator, the cleaning device comprises a cleaning space connected by the second suction channel to the conventional dust collection system of the rock drilling rig, the cleaning device being arranged to utilize the suction formed with the suction device to clean the footwear, the cleaning device is provided with at least one control unit for controlling the exhaust suction, and the cleaning device is arranged to the vicinity of the entrance of the control cabin.

17. A rock drilling rig according to claim 12, wherein the rock drilling rig comprises at least one cleaning device for cleaning the footwear of the operator, the cleaning device comprises a cleaning space connected by the second suction channel to the conventional dust collection system of the rock drilling rig, the cleaning device being arranged to utilize the suction formed with the suction device to clean the footwear, the cleaning device is provided with at least one control unit for controlling the exhaust suction, and the cleaning device comprises at least one cleaning member for mechanically removing dust from the footwear.

18. A method for sucking dust in connection with a rock drilling rig, the rock drilling rig comprising a movable carrier, a control cabin, at least one drill boom provided with a drilling unit, and a dust collection system, the method comprising:

sucking dust produced in drilling with the dust collection system from the drilling point, using the conventional dust collection system of the rock drilling rig to remove dust from at least one predetermined second location other than the drilling point, directing exhaust suction produced to the second location by means of at least one control unit, supplying suction from the conventional dust collection system of the rock drilling rig to at least one cleaning device arranged in connection with the entrance of the control cabin of the rock drilling rig, controlling the exhaust suction of the cleaning device by means of the control unit, and cleaning dust from the footwear of the operator of the rock drilling rig in the cleaning device.

19. A rock drilling rig, comprising:

a movable carrier provided with at least one drilling boom at the outer end of which is a rock drilling unit comprising at least a feed beam and a rock drilling machine, a control cabin, a dust collection system containing at least a suction device, filters and a first suction channel, the dust collection system being arranged to suck dust through a first suction channel from a drill hole drilled with the rock drilling machine, at least one second suction channel connected to the dust collection system, and wherein the suction device of the dust collection system is configured to produce a suction effect through the second suction channel at least to one predetermined second location other than the drill hole, the rock drilling rig comprises at least one control unit enabling the suction effect produced at the second location to be controlled, the rock drilling rig comprises at least one cleaning device for cleaning the footwear of the operator, the cleaning device comprises a cleaning space connected by the second suction channel to the conventional dust collection system of the rock drilling rig, the cleaning device being arranged to utilize the suction formed with the suction device to clean the footwear, and the cleaning device is provided with at least one control unit for controlling the exhaust suction.

20. A rock drilling rig, comprising:

a movable carrier provided with at least one drilling boom at the outer end of which is a rock drilling unit comprising at least a feed beam and a rock drilling machine, a control cabin, a dust collection system containing at least a suction device, filters and a first suction channel, the dust collection system being arranged to suck dust through a first suction channel from a drill hole drilled with the rock drilling machine, at least one second suction channel connected to the dust collection system, and wherein the suction device of the dust collection system is configured to produce a suction effect through the second suction channel at least to one predetermined second location other than the drill hole, the rock drilling rig comprises at least one control unit enabling the suction effect produced at the second location to be controlled, the rock drilling rig comprises at least one hand-held suction unit, and the suction unit is connected by the second suction channel to the conventional dust collection system of the rock drilling rig, and at least one hand-held suction unit arranged in the control cabin.

* * * * *